US006843007B2

(12) United States Patent
Santarpia

(10) Patent No.: US 6,843,007 B2
(45) Date of Patent: Jan. 18, 2005

(54) DISPLAY CARD AND PRODUCTION METHOD

(75) Inventor: Gaetano Santarpia, Milan (IT)

(73) Assignee: The Gerffert Company, Inc., Long Island City, NY (US)

( * ) Notice: Subject to any disclaimer, the term of this patent is extended or adjusted under 35 U.S.C. 154(b) by 0 days.

(21) Appl. No.: 10/238,921

(22) Filed: Sep. 10, 2002

(65) Prior Publication Data

US 2003/0061745 A1 Apr. 3, 2003

(30) Foreign Application Priority Data

Sep. 11, 2001 (IT) ..... MI2001A1897

(51) Int. Cl.[7] ..... G09F 1/00
(52) U.S. Cl. ..... 40/124.06; 40/124.191
(58) Field of Search ..... 40/124.01, 124.06, 40/124.191, 323; 206/469, 470, 486, 488

(56) References Cited

U.S. PATENT DOCUMENTS 3,476,239 A * 11/1969 Jacob ..... 206/461
3,942,640 A * 3/1976 Hellstrom ..... 206/469
4,870,764 A * 10/1989 Boone ..... 40/124.06
5,161,826 A * 11/1992 Van Giesen et al. ..... 283/77
5,984,099 A * 11/1999 Shimizu et al. ..... 206/462
6,082,029 A * 7/2000 Hoffman ..... 40/124.06
6,128,840 A 10/2000 Boisvert ..... 40/124.191
6,139,664 A * 10/2000 Melzer et al. ..... 156/73.1
6,308,832 B1 * 10/2001 Pirro et al. ..... 206/469
6,364,113 B1 * 4/2002 Faasse et al. ..... 206/469

* cited by examiner

*Primary Examiner*—Lars A. Olson
(74) *Attorney, Agent, or Firm*—Darby & Darby

(57) ABSTRACT

A display card (4) comprises of a supporting body or core (1) with two opposed display faces and a display aperture (2), protective moans (3, 3') arranged on the supporting body (1); so its to create a recessed seat (8) in line with the display aperture (2), and a display object (9) with two opposed display faces, arranged inside the recessed seat (b) and held therein by securing; means (10).

12 Claims, 3 Drawing Sheets

FIG. 2
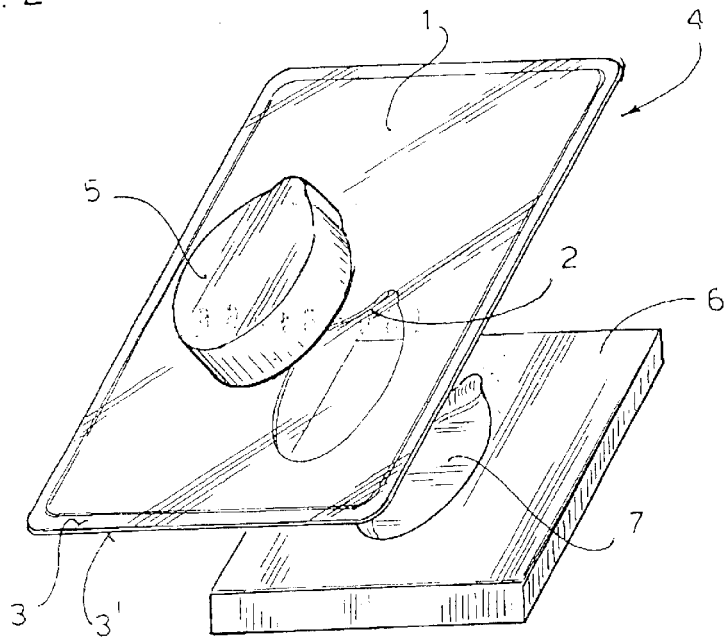
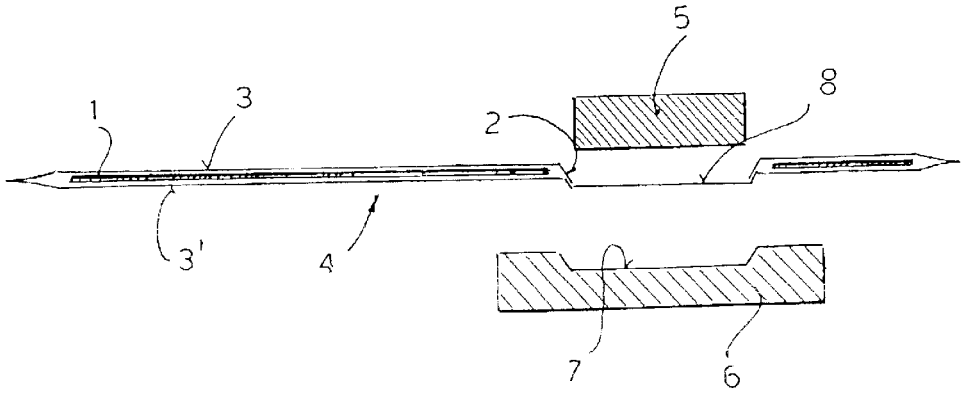
FIG. 2A

FIG. 3
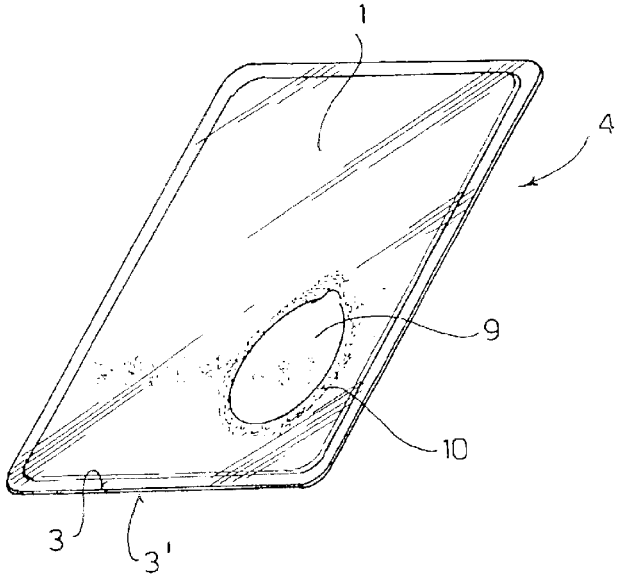
FIG. 3A
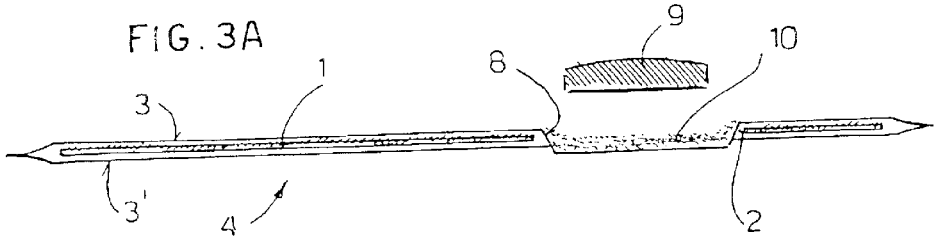
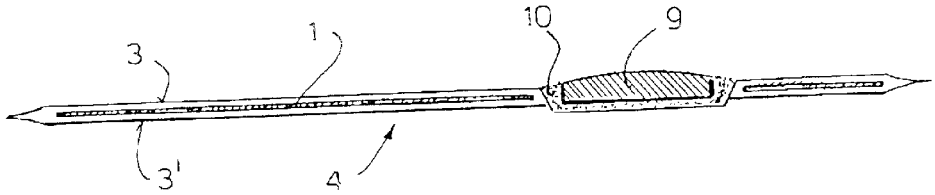
FIG. 3B

DISPLAY CARD AND PRODUCTION METHOD

This application claims priority from Italian Patent Application No. MI2001A001897, the contents of which are hereby incorporated by reference.

The present invention relates in general to a display card for displaying collectible items such as medals, coins, stamps, fluids and the like, and in particular to a display card for displaying a medal representing a sacred image.

BACKGROUND

Currently, various types of known display cards, containing words and/or images have a window or aperture in which a display object is supported.

For example, U.S. Pat. No. 6,128,840 describes a display comprising a card body with a display aperture. The card body has a core layer sandwiched between two protective layers. A self-adhesive tape is applied to a surface of the card body so as to cover the aperture. The object to be displayed is placed in the aperture and thus adheres to the adhesive tape with a clearance in relation to the edge of the aperture. A ring of adhesive material is placed in the clearance so as to secure the object to the edge of the aperture.

The production of such a display card is somewhat laborious, complex and thus costly. The card is complex as it has additional elements, such as the adhesive layer to support the object and the adhesive ring that binds the object to the edge of the aperture. The production method is also complex, especially in view of the need to position the adhesive rim around the edge of the object, which is a delicate and precise operation.

OBJECTS OF THE INVENTION

The object of the present invention is to eliminate the drawbacks of the prior art by providing a display card that is practical, inexpensive and simple to produce.

SUMMARY OF THE INVENTION

The display card according to the invention comprises a supporting body or core with two opposed display faces and a display aperture. The supporting body is covered or coated by protective means so as to create a recessed seat in register with the display aperture. An adhesive is applied inside this recessed seat. The object to be displayed, having two opposed display faces, is arranged inside the recessed seat and held in place therein by this adhesive. The display card thus consists of a minimum number of components and its production process is simple and quick.

THE DRAWINGS

Further characteristics of the invention shall become clearer from the detailed description that follows referring to an exemplary embodiment thereof illustrated in the accompanying drawings, in which:

FIG. 2 is a perspective schematic view showing a second phase of the display card production process according to the invention;

FIG. 2A is an enlarged cross sectional view, showing the card at the end of the second phase of the display card production process according to the invention;

FIG. 3 is a perspective schematic view, as in FIG. 1, showing a third phase of the production process of the display card according to the invention;

FIG. 3A is an enlarged cross sectional view, showing the card components in the third phase of the production process of the display card according to the invention; and FIG. 3B is a cross sectional view showing the card after the third phase of the production process of the display card according to the invention.

DETAILED DESCRIPTION

With the aid of the drawings a display card according to the invention and its production method are described.

Figure 1:
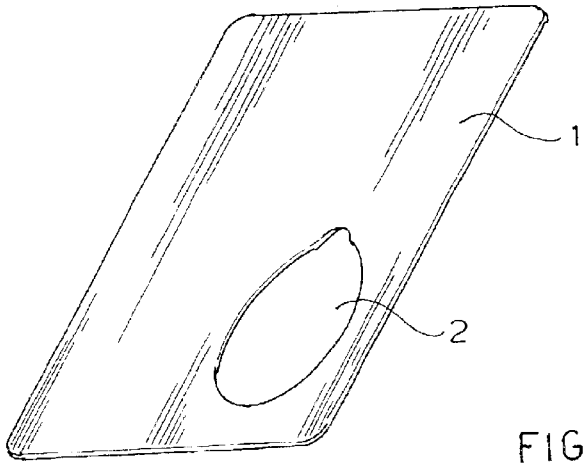
FIG. 1 is an exploded, perspective schematic view, showing components of the invention at the start of the first step of the display card production process according to the invention.

FIG. 1 shows a supporting body or core of the display card, indicated as a whole with the reference number 1. The core 1 is a plate of an essentially rectangular shape, so as to define two opposed display surfaces which with reference to the figures are the bottom and top surface.

The core 1 is preferably made from a material suitable to support printing so that images, wording, distinctive marks and the like can be represented. Card, paper, plastic, etc., can be used as the material for core 1.

The core 1 is preferably produced by die-cutting. Using a die-cutting press, the peripheral outline of the core 1 is cut and inside this an aperture or window 2 is produced. The aperture 2 may have a substantially elliptical shape.

After die-cutting, the core 1 is fed to a laminating machine which, by introducing the core into a "pouch", covers the core 1 with two transparent plastic layers 3, 3' by a heat-sealing heat process.

The transparent plastic layers 3, 3' have a substantially rectangular shape with slightly larger dimensions than core 1. In this way a card 4 is obtained in which the peripheral parts of the two layers 3, 3' are heat-sealed together and the core 1 is sandwiched between the plastic layers 3, 3'. Therefore, the card has a transparent perimetric frame composed of the edges of the layers 3, 3' heat-sealed together. The aperture 2 of the core 1 is covered, respectively, on the top and on the bottom by the layers 3, 3' which are also heat-sealed together.

Figure 1A:
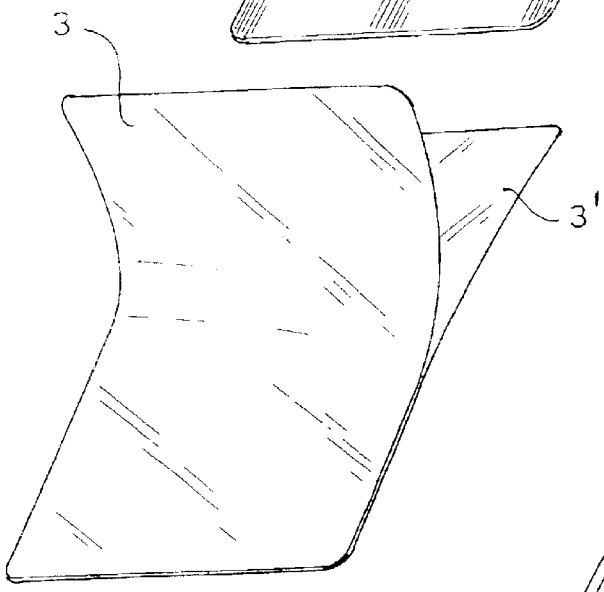
FIG. 1A is a perspective view showing the components at the end of the first step of the display card production process according to the invention.
Figure 1A:
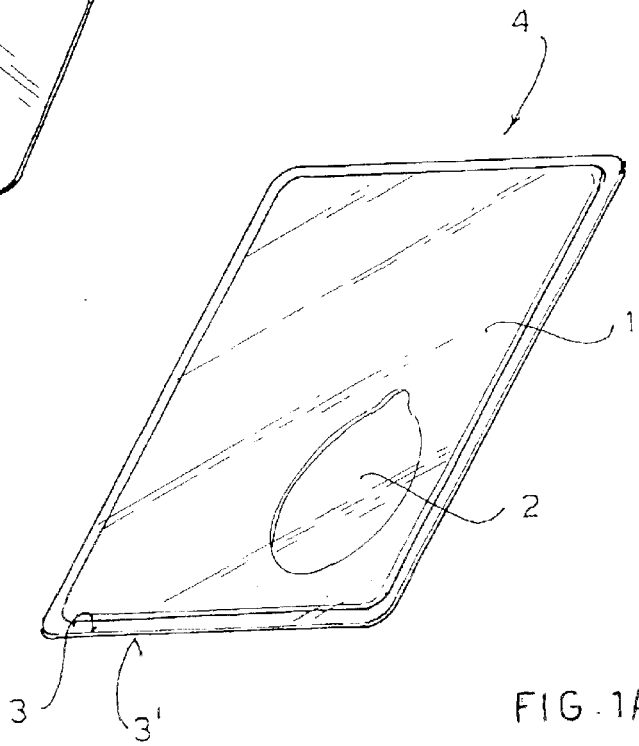

In this way the wording and/or images represented on the core 1 are protected from wear and tear by the two transparent plastic layers 3, 3' and a card like the one shown in FIG. 1A is obtained.

With reference to FIG. 2, after the heal-scaling process of the transparent plastic layers 3, 3', the card 4 is sent to a punching phase, shown in FIGS. 2 and 2A. The card 4 is placed between a male metal punch 5 and a matrix 6. The punch 5 has substantially the same configuration of the aperture 2 of the core 1 and the matrix 6 has a recessed seat 7 that has substantially the same configuration of the aperture 2. Therefore the card 4 is arranged with the aperture 2 of the core 1 in register with the punch 5 and with the recessed seal 7 of the matrix 6.

A cold punching process is then performed, during which the punch 5 is pressed onto the card 4 in the position of the aperture 2 of the core 1. Hence, the transparent plastic layers 3, 3' are compressed and pressed downward to adopt the configuration of the seat 7 of the matrix. Consequently, as shown in FIG. 2A, at the end of the punching phase, the card 4 has a recessed cup-shaped seat 8, arranged in the position of the aperture 2. The bottom surface of the bottom transparent plastic layer 3' has a slight projection towards the outside in the position of the cup-shaped seat 8.

Upon conclusion of the cold punching phase, as shown in FIGS. 3, 3A and 3B, a final phase is performed to insert the object 9 to be displayed. In this specific case, purely as an example, the object to be displayed is a metal object, such as a medal, the top surface of which may be treated with a transparent enamel or laminated layer to protect it from wear and tear.

The medal 9, for example, may represent a sacred image, such as a Madonna, a saint or another sacred symbol, and has a configuration that generally corresponds to the configuration of the cup-shaped seat 8.

As shown in FIG. 3A, transparent adhesive 10, such as a two-component polyurethane based adhesive, is applied to the cup 8. Subsequently, as shown in FIG. 3B, the medal 9 is housed in the cup-shaped seat 8 on the transparent adhesive 10. Consequently, the transparent adhesive 10 expands in the cup 8 to attach to the bottom surface and the side edges of the medal 9 which remains attached to the card 4. As both the adhesive 10 and the plastic layers 3, 3' are transparent, the bottom surface of the medal 9 is also visible from the bottom part of the card 4.

After application of the transparent adhesive 10 and the display object 9, the display card 4 is completed and ready to be placed on the market.

Numerous variations and modifications to details apparent to those skilled in the art, may be made to the present embodiment of the invention, without however departing from the scope of the invention set forth in the attached claims.

What is claimed is:

1. A display card comprising:

a supporting body having two opposed display faces and a display aperture, protective means arranged on said supporting body;

a recessed seat formed by deforming said protective means;

said recessed seat being in register with said display aperture, and an object to be displayed with two opposed display faces, arranged inside said recessed seat and held therein by securing means.

2. A display card as claimed in claim 1, wherein said supporting body is a card substantially in the form of a rectangular plate, with wording or images on at least one of said display faces.

3. A display card as claimed in claim 1, wherein said protective means comprise at least one transparent protective layer arranged on said supporting body.

4. A display card as claimed in claim 3, wherein said protective means comprises two transparent plastic layers heat-sealed together so as to sandwich said supporting body therebetween.

5. A display card as claimed in claim 1, wherein said recessed seat is cup-shaped and comprises a bottom edge that projects slightly from the bottom surface of said display card.

6. A display card as claimed in claim 1, wherein said securing means comprise a transparent adhesive.

7. A display card as claimed in claim 6, wherein said transparent adhesive is a polyurethane based two-component adhesive.

8. A display card as claimed in claim 1, wherein said object to be displayed is a metal medal, representing a sacred image.

9. A method for producing a display card, comprising:

providing a supporting body having two opposed display surfaces and a display aperture;

covering said supporting body with protective means which extends over said display aperture, so as to obtain a display card;

punching said display card in register with said display aperture, so that said protective means deforms to creates a recessed seat in line with said display aperture;

applying securing means in said recessed seat; and placing an object to be displayed inside said recessed seat so that said securing means adheres to said object to be displayed.

10. The method as claimed in claim 9, wherein said step of covering comprises heating-sealing at least one transparent plastic layer to said supporting body.

11. The method as claimed in claim 9, wherein said punching step comprises pressing said protective means by a male punch with an outline substantially similar to the outline of said display aperture on a matrix with a recessed seat with an outline substantially similar to the outline of said display aperture.

12. The method as claimed in claim 9, wherein said step of applying securing means, comprises applying a transparent polyurethane based two-component adhesive in said recessed seat.

* * * * *